US007122949B2

(12) United States Patent
Strikovski

(10) Patent No.: US 7,122,949 B2
(45) Date of Patent: Oct. 17, 2006

(54) CYLINDRICAL ELECTRON BEAM GENERATING/TRIGGERING DEVICE AND METHOD FOR GENERATION OF ELECTRONS

(75) Inventor: Mikhail Strikovski, Rockville, MD (US)

(73) Assignee: Neocera, Inc., Beltsville, MD (US)

( * ) Notice: Subject to any disclaimer, the term of this patent is extended or adjusted under 35 U.S.C. 154(b) by 127 days.

(21) Appl. No.: 10/870,992

(22) Filed: Jun. 21, 2004

(65) Prior Publication Data

US 2005/0280345 A1 Dec. 22, 2005

(51) Int. Cl.
*H01J 17/26* (2006.01)
*H01J 61/28* (2006.01)

(52) U.S. Cl. ..... 313/231.31; 118/723 R; 118/723 EB

(58) Field of Classification Search ..... 313/231.31, 313/631; 118/723 R–723 E; 250/504 R
See application file for complete search history.

(56) References Cited

U.S. PATENT DOCUMENTS 5,276,386 A * 1/1994 Watanabe et al. ..... 315/111.21
5,389,902 A * 2/1995 Kameya ..... 333/138
6,422,172 B1 * 7/2002 Tanaka et al. ..... 118/723 R
6,441,554 B1 * 8/2002 Nam et al. ..... 315/111.21
6,617,770 B1 * 9/2003 Machida ..... 313/231.01
6,800,336 B1 * 10/2004 Fornsel et al. ..... 427/562

* cited by examiner

*Primary Examiner*—Joseph Williams
*Assistant Examiner*—Bumsuk Won
(74) *Attorney, Agent, or Firm*—Rosenberg, Klein & Lee

(57) ABSTRACT

A surface discharge device performing functions of a trigger and electron beam generator includes a cylinder shaped member formed from a dielectric material with dielectric constant $\epsilon>100$, in which a central opening is formed having a conical or cylindrical shape. An internal electrode is electrically coupled to the internal surface of the cylinder shaped member. An external electrode covers the external surface of the cylinder shaped member. A triggering pulse is applied between the external and internal electrodes to generate emission of electrons in the central opening and formation of the conducting plasma to ignite the device and serve as a source of electrons for generating an electron beam. The conducting plasma charges a capacitor formed by the cylinder shaped dielectric member and the external electrode. The cylinder shaped member is positioned in a hollow cathode having a central bore hole in the bottom. An anode is positioned remotely from the cathode and an electric field exists dynamically in space between the cathode and anode for at least a portion of the duration of the triggering pulse.

29 Claims, 1 Drawing Sheet

CYLINDRICAL ELECTRON BEAM GENERATING/TRIGGERING DEVICE AND METHOD FOR GENERATION OF ELECTRONS

FIELD OF THE INVENTION

The present invention relates to the generation of electrons and in particular to methods of generating spatial regions of high concentrations of electrons.

More in particular, the present invention relates to a technique for generation of initial electrons in pulsed discharge devices with a restricted discharge of cylindrical geometry as for example, in pseudo-spark switches, channel spark discharge devices, etc.

Specifically, the present invention relates to a cylindrical surface discharge device designed to fulfill two functions in combination, such as triggering of the generation of electrons and for generating the electrons, in the form of electron beams. Viewed as a trigger, such a device provides sufficient conditions for a pulse discharge device to ignite. When viewed as a generator, the device creates electron discharge, and to some extent controls the intensity of the discharge.

Further, the present invention relates to a cathode (or cathode assembly) capable of generating a focused electron beam thus functioning as an electron beam source. If the device is located inside of a hollow cathode, then the device may function as a trigger to ignite an electron beam source.

BACKGROUND OF THE INVENTION

"Free electrons" are the electrons which are controlled, meaning the electrons may be extracted from the electron source, accelerated, and directed in a specified direction. For generation of "free electrons", the electron source should provide conditions for efficient emission of electrons from a cathode. Direct extraction of electrons from a metal surface by applying an electric field, defined as an auto electron emission requires a high electric field and is known to be limited in the current density.

As an alternative approach to the direct extraction of electrons, electron sources use triggers in which the current pulse passes through a gas, converting it into highly ionized state, called a plasma, which is a good emitter as it has no potential barrier preventing the emission of electrons.

The main electrical triggering technique used in conventional electron generating devices is surface flashover in which a current pulse flows in a gas along a dielectric surface that assists the discharge ignition. For low pressure gases or vacuum, this surface supplies the discharge media (absorbed gas molecules, surface defects, sharp edges, inclusions of foreign materials, etc.). In this technique, discharge literally flashes over the dielectric surface. Disadvantages of such a trigger of the discharge ignition are (1) limited emission of electrons and (2) short lifetime. Both of these disadvantages are related to the fact that current tends to flow through a narrow channel between metallic electrodes of the device. As a result, volume of the plasma channel is limited, and accordingly so is the emitted electron current. Additionally, due to the current confinement into the channel dielectric surface erosion limits lifetime of the trigger to as little as $10^6$ pulses.

Other electron emitters make use of some specific material such as dielectrics (or ferro electrics) with high dielectric constant $\epsilon \sim 1000$ to overcome the problems associated with limited electron emission and shortened lifetime. A typical electron emitter consists of a dielectric plate mounted between two electrodes positioned on opposite sides thereof, such that one electrode covers the side of the plate completely, while another, e.g., a face electrode, leaves significant area of the side of the dielectric plate uncovered.

Presence of the high $\epsilon$ dielectric facilitates performance of such an electron emitter. First, the emitter can work at lower voltages as it amplifies and focuses an electric field on the edge of the face electrode. Second, it provides distribution of the surface/over-current over larger area as it creates an integrated distributed capacitor that the discharge current tends to charge. Third, due to the distributed nature of the discharge, erosion of the surface is reduced, and lifetime of such a device is elongated.

This design of electron generators/triggers is suitable for large area electron switches or electron guns. However, due to their distributed nature, the design is less effective for some devices where the generated electrons should be concentrated in narrow beams. In this case, only a small fraction of the trigger area, which is located in the vicinity of the device/beam axis, works effectively.

A more effective generator/trigger device than that found in the prior art is needed for generation of focused electron beams.

SUMMARY OF THE INVENTION

It is an object of the present invention to provide a surface discharge device for electron beam generation, as well as for discharge triggering to create a sufficient condition for ignition of a pulse discharge for the generation of electrons. Such a device has a controllable intensity of the discharge, long lifetime, and an effective electron emission.

In one aspect, the present invention is a device for electron beam generation which includes a cylindrically contoured member formed of a dielectric material with $\epsilon > 100$; an internal electrode electrically coupled to the cylindrically contoured member on an internal surface defined by a cylindrically or conically shaped central opening extending longitudinally along the symmetry axis of the cylinder-shaped member; an external electrode electrically coupled to the cylinder-shaped member on an external surface thereof; a source of a triggering pulse coupled between the internal and external electrodes; and a cathode member electrically coupled to the external electrode. The sidewalls of the cathode member surround at least a portion of the external surface of the cylindrically contoured member. The bottom of the cathode member has a central bore opening formed therein and disposed in alignment with the central opening of the cylindrically contoured member.

A dielectric tube is secured at one end to the cathode member at the central bore opening, and an anode member is disposed remotely from another end of the dielectric tube. Preferably, an insulation member is positioned between the cathode member and the anode member. The insulation member is attached to the dielectric tube between two ends.

A source of voltage is coupled to the anode member to create a voltage difference between the cathode member and the anode member during at least a portion of a duration of the triggering pulse.

Upon application of the triggering pulse between the internal and external electrodes, an electric field in the vicinity of the internal electrode creates electron emission from the internal surface of the cylinder-shaped member and formation of a conducting plasma in the central opening thereof The conducting plasma expands along the internal surface until a capacitor formed by the cylindrically contoured member and the external electrode is substantially fully charged. The conducting plasma creates a central electrode of the capacitor and triggers the surface discharge along the internal surface of the cylindrically contoured member. The surface discharge stops when the central opening of the cylinder shaped member is substantially completely occupied by the conducting plasma. The electrical field existing between the cathode member and the anode member accelerates electrons of the conducting cathode plasma and extracts these electrons towards the anode member thus forming an electron beam. The dielectric tube constricts the diameter of said plasma.

The energy of the surface discharge is controlled by the amplitude and duration of the triggering pulse and by capacitance of said capacitor.

The present invention further is directed to a method for generating an electron beam, which includes:

- forming a central opening in a cylinder-shaped member formed from a dielectric material having a dielectric constant $\epsilon>100$,
- connecting an internal electrode to an internal surface of the cylinder-shaped member defined by the central opening,
- connecting an external electrode to an external surface of the cylindrically contoured member,
- positioning the cylinder-shaped member in close proximity to a cathode member, wherein sidewalls of the cathode surround at least a portion of the cylinder-shaped member and the central opening of the cylindrically contoured member is aligned with a central bore opening formed in the bottom of the cathode member;
- coupling the cathode member to the external electrode;
- positioning an anode member remotely from the cathode member;
- applying a triggering pulse between the internal and external electrodes to create electron emission from the internal surface of the cylinder-shaped or cylindrically contoured member and to form conducting plasma in the central opening thereof expanding along the central opening until a capacitor formed by the cylinder-shaped member and the external electrode has been substantially fully charged; and
- applying a voltage to the anode member to create a voltage difference between the cathode and anode members for at lest a portion of a duration of the triggering pulse to accelerate the electrodes of the conducting plasma in the central opening of the cylinder-shaped member and to extract said electrodes from the cathode member through the central bore opening towards the anode member in the form of an electron beam.

Another aspect of the present invention is directed to a trigger in an electron generating device. The trigger includes a cylinder-shaped member formed of a dielectric material. An internal electrode is electrically coupled to the cylinder-shaped member on an internal surface. An external electrode is electrically coupled to the cylinder-shaped member on an external surface. A source of the triggering pulse is coupled between the internal and external electrodes. Upon application of the triggering pulse between the internal and external electrodes, an electric field formed in vicinity of the internal electrode creates electron emission from the internal surface of the cylinder-shaped member and formation of a conducting plasma filling the central opening formed therein. The conducting plasma creates a central electrode of a capacitor formed by the cylinder-shaped member and the external electrode and triggers the surface discharge along the internal surface of the cylinder-shaped member, thereby igniting the electron generating device.

The formation of the conducting plasma is controlled by the amplitude and duration of the triggering pulse and by capacitance of said capacitor.

The present invention further is directed to a method of triggering the generation of electrons in an electron generating device. The triggering method includes the steps of:

- forming a central opening in a cylinder-shaped member made from a dielectric material having a dielectric constant $\epsilon>100$,
- connecting an internal electrode to an internal surface of the cylinder-shaped member,
- connecting an external electrode to an external surface of the cylinder-shaped member; and
- applying a triggering pulse between said internal and external electrodes to create electrons emission from the internal surface of said cylinder-shaped member and to form conducting plasma in the central opening thereof. The conducting plasma expands along the central opening until a capacitor formed by the cylinder-shaped member and the external electrode has been substantially fully charged thus igniting the electrons generating device.

These features and advantages of the present invention will be fully understood and appreciated from the following Detailed Description of the Accompanying Drawings.

DETAILED DESCRIPTION OF THE PREFERRED EMBODIMENT

Figure 1:
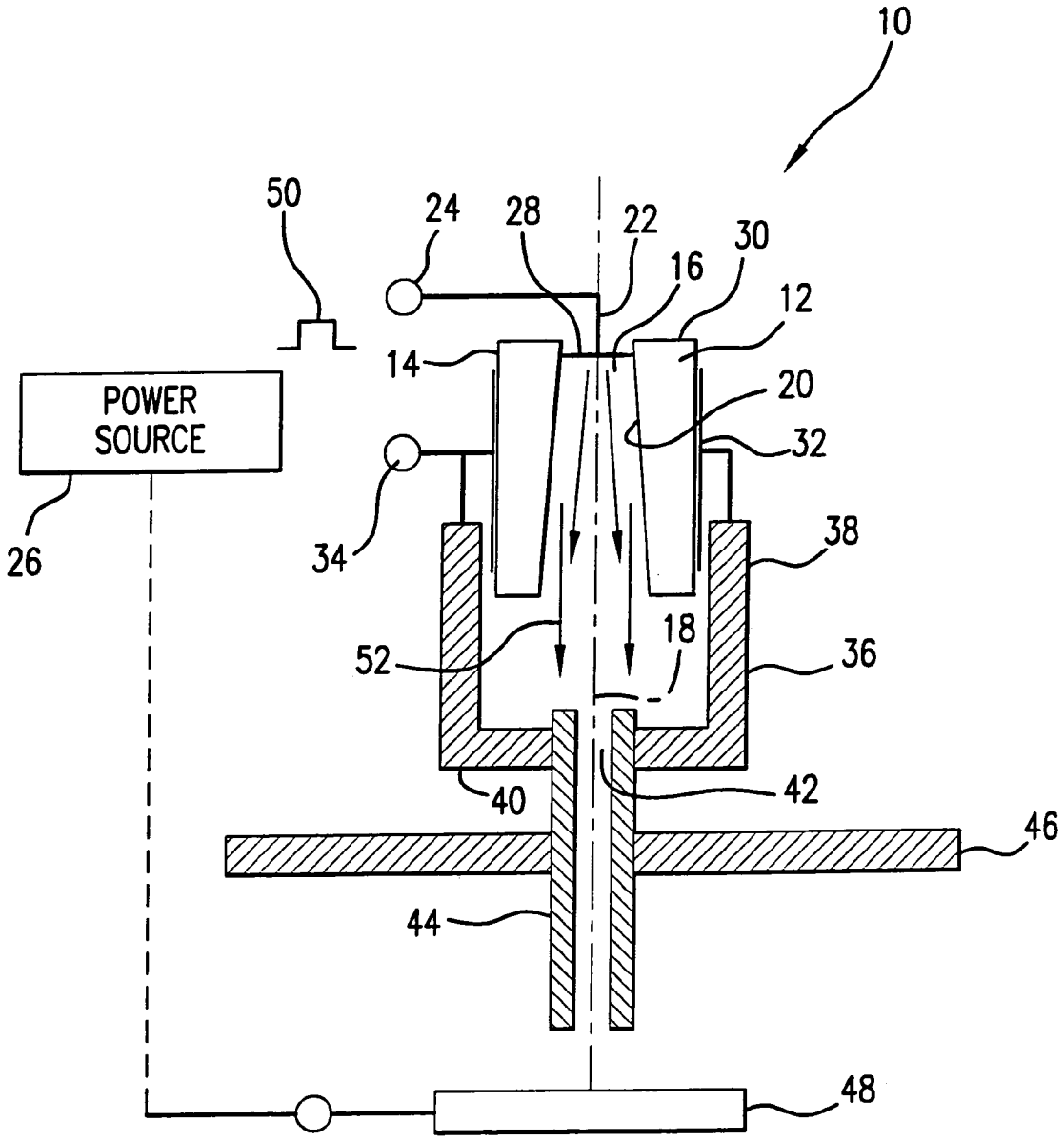
FIG. 1 shows schematically the design of the cylindrical surface discharge electron generating/triggering device of the present invention.

Referring to FIG. 1, the cylindrical surface discharge device 10 of the present invention includes a cylindrically contoured or cylinder shaped member 12 formed of a dielectric material with dielectric constant $\epsilon$ in excess of 100. The cylinder shaped member 12 has an external surface 14 and is formed with a central opening 16 extending longitudinally through the cylinder shaped member 12 along the axis of symmetry 18 thereof. The central opening 16 may be shaped as a cylinder or a cone. The surface of the central opening 16 defines an internal surface 20 of the cylinder shaped member 12. The diameter of the central opening 16 may range from 3 to 15 mm.

The cylindrical surface discharge device 10 further includes an internal electrode 22 having a terminal 24 connected to a power source 26 and an opposite end 28 positioned in contact with the cylinder shaped member 12 in proximity to the edge 30 thereof. Specifically, as shown in FIG. 1, the internal electrode 22 makes contact at the end 28 to some part of the internal surface 20 of the cylinder shaped member 12.

An external electrode 32 is connected by the terminal 34 to the power source 26. Preferably, the external electrode 32 is formed as a metallization coating which covers substantially the entire external surface of the cylinder shaped member 12.

The cylindrical surface discharge device 10 further includes a cylindrical metal electrode (cathode) 36 which has sidewalls 38 and a bottom portion 40. The cathode 36 is electrically coupled to the external electrode 32. The bottom portion 40 of the cathode 36 is formed with a central bore hole 42 which coincides with the central opening 16 of the cylinder shaped member 12 when the latter is positioned in close proximity to or inside the cathode 36. In this manner, the sidewalls 38 of the cathode 36 surround the external surface 14 of the cylinder shaped member 12.

A dielectric tube 44 is attached to the cathode 36 and includes central bore hole 42. Further, a dielectric insulator plate 46 is positioned between the cathode 36 and an anode 48 to electrically isolate one member from the other. The anode 48 is coupled to a power source 26, or alternatively to another power source (not shown in the drawing).

In the cylindrical surface discharge device 10, the cylinder shaped member 12 coupled to the power source 26 for receiving a triggering pulse 50 represents a trigger portion of the cylindrical surface discharge device of the present invention while the overall design shown in FIG. 1 represents an electron beam generating device. The concept underlying the design of the device 10 of the present invention is the creation of cylindrically shaped discharge which propagates along the surface of high $\epsilon$ dielectric material in order to function as a trigger/generator for axial symmetry devices with an electron concentration such as, for example, electron beam generators.

When a pulsed voltage (triggering pulse) 50 is applied between the internal electrode 22 and external electrode 32, a strong electric field in the vicinity of the end 28 of the internal electrode 22 causes electron emission and formation of conducting plasma in the central opening 16, e.g., triggering the sliding surface discharge. The plasma inside the central opening 16 expands (slides) along the dielectric internal surface 20 of the cylinder shaped member 12 driven by the longitudinal component of electric field, which exists until the capacitor formed by the dielectric material of the cylinder shaped member 12 and the external electrode 32 is fully charged.

Due to the driving force, the discharge is distributed uniformly over the internal surface 14. The discharge is terminated only when the surface 14 is totally occupied by plasma. The plasma creates an "electrode" of the cylindrical capacitor formed by the dielectric of the cylinder shaped member 12 having the external electrode 32 on one side thereof and the "plasma electrode" on the internal surface 20 thereof. The energy of the discharge can be controlled by the voltage of the triggering pulse 50 as well as by changing the capacitance of the capacitor formed by the dielectric material and the external electrode 32 in the presence of the plasma electrode.

As shown in FIG. 1, the cathode 36, as well as anode 46, are coupled to the power source in order that a potential difference exists therebetween which creates an electrical field at least during some portion of the duration of the triggering pulse 50. The electrical field between the cathode 36 and the anode 48 facilitates the extraction and acceleration of electrons 52 produced inside the hollow cathode 36. The electrical field dynamically distributed in space between the cathode 36 and the anode 48 accelerates the electrons 52 through the dielectric tube 44, which, in combination with the dielectric insulator plate 46, constricts the cathode plasma emerging from the hollow cathode bore hole 42 towards the anode 48. The dielectric tube 44 and the insulator dielectric plate 46, in addition to constricting the cathode plasma and the electron beam provide for insulation between the cathode 36 and anode 48 so that no discharge occurs between them in absence of the triggering pulse 50.

For narrow beam sources of electrons, the cylindrically shaped device of the present invention is a highly effective trigger as well as electron emitter/generator as it provides both the large area plasma and precise location of the elevated concentration of the electrons exactly around the device axis. In addition, the high $\epsilon$ cylinder shaped member 12 focuses the electric field of anode 48 that initially penetrates inside the cathode 36 through the central bore hole 42. Such a focusing intensifies extraction of the electrons from the plasma inside the central opening 16 of the cylinder shaped member 12. Viewed as a trigger, the device of the present invention provides sufficient conditions for a pulse discharge device to ignite. When viewed as an electron generator, the device creates electrons and controls the intensity of the discharge. The device of the present invention may serve as a cathode itself or it can be a part of a cathode assembly, for example, it can be located inside of a hollow cathode and serve as the main trigger unit of an electron source.

Although this invention has been described in connection with specific forms and embodiments thereof, it will be appreciated that various modifications other than those discussed above may be resorted to without departing from the spirit or scope of the invention as defined in the appended Claims. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. Electron beam generating device, comprising:

a cylinder-shaped member formed of a dielectric material having a dielectric constant $\epsilon>100$, said cylinder-shaped member having an external surface and a central opening formed therethrough defining an internal surface thereof, said central opening extending longitudinally along the symmetrical axis of said cylinder-shaped member;

an internal electrode electrically coupled to said cylinder-shaped member at said internal surface thereof;

an external electrode electrically coupled to said cylinder-shaped member at said external surface thereof;

triggering source means for triggering a pulse, said triggering source means coupled between said internal and external electrodes;

a cathode member electrically coupled to said external electrode, said cathode member having sidewalls and a bottom section, the sidewalls of said cathode member being in surrounding relationship with at least a portion of said external surface of said cylinder-shaped member, said bottom section of said cathode member having a central bore opening formed therein and disposed in alignment with said central opening of said cylinder-shaped member; and an anode member disposed remotely from said central bore opening along said symmetrical axis of said cylinder-shaped member, wherein, upon application of said pulse between said internal and external electrodes, a sliding surface discharge is created along said internal surface of said cylinder-shaped member to produce electrons, said electrons being concentrated at said symmetrical axis of said cylinder-shaped member, and wherein an electrical field between said cathode and anode members accelerates said concentrated electrons to a high energy, thus forming a high-energy electron beam, and extracts said high energy electron beam through said central bore opening of said cathode member towards said anode member.

2. The device of claim 1, further comprising means for creating a voltage difference between said cathode member and said anode member during at least a portion of duration of said triggering pulse, said means for creating said voltage difference being coupled to said anode member.

3. The device of claim 1, further comprising an insulation member disposed between said cathode member and said anode member.

4. The device of claim 1, further comprising a dielectric tube secured by one end thereof to said cathode member at said central bore opening thereof, said anode member being disposed remotely from another end of said dielectric tube.

5. The device of claim 1, wherein said internal electrode is disposed in said central opening of said cylinder-shaped member.

6. The device of claim 1, wherein said internal electrode is disposed in contact with a portion of said internal surface of said cylinder-shaped member.

7. The device of claim 1, wherein said central opening of said cylinder-shaped member is cylindrically shaped.

8. The device of claim 1, wherein said central opening of said cylinder-shaped member is conically-shaped.

9. The device of claim 1, wherein the diameter of said central opening of said cylinder-shaped member is in the range of 3–15 mm.

10. The device of claim 1, wherein said external electrode envelopes said external surface of said cylinder-shaped member.

11. The device of claim 10, wherein said external surface of said cylinder-shaped member is metallized, said metallization forming said external electrode.

12. The device of claim 4, wherein said dielectric tube constricts a diameter of a cathode plasma and an electron beam formed of electrons migrating from said cathode member to said anode member.

13. A method for generating an electron beam, comprising the steps of:

forming a central opening in a cylinder-shaped member formed from a dielectric material having a dielectric constant $\epsilon>100$, said central opening extending longitudinally of said cylinder-shaped member along the axis of symmetry thereof;

connecting an internal electrode to an internal surface of said cylinder-shaped member, said internal surface being defined by said central opening;

connecting an external electrode to an external surface of said cylinder-shaped member;

positioning said cylinder-shaped member in proximity to a cathode member having sidewalls and a bottom, said sidewalls of said cathode member being in surrounding relationship with at least a portion of said external surface of said cylinder-shaped member, said central opening of said cylinder-shaped member being substantially aligned with a central bore opening formed in said bottom of said cathode member;

electrically coupling said cathode member to said external electrode;

positioning an anode member remotely from said cathode member;

applying a triggering pulse between said internal and external electrodes to create electrons emission from said internal surface of said cylinder-shaped member and to form conducting plasma in said central opening thereof expanding along said central opening until a capacitor formed by said cylinder-shaped member and said external electrode has been substantially fully charged; and applying a voltage to said anode member to create a voltage difference between said cathode and anode members for at least a portion of a duration of said triggering pulse to accelerate the electrons of said conducting plasma in said central opening of said cylinder-shaped member and to extract said electrons from said plasma through said central bore opening towards said anode member in the form of a electron beam.

14. The method of claim 13, further comprising the step of:

attaching one end of a dielectric tube to said central bore opening formed in said cathode member to constrict the diameter of said plasma and electron beam.

15. The method of claim 14, further comprising the step of:

attaching an insulating member to said dielectric tube between said cathode member and said anode member.

16. The method of claim 13, further comprising the step of:

forming said central opening in said cylinder-shaped member in the contour of a cylinder.

17. The method of claim 13, further comprising the step of:

forming said central opening in said cylinder-shaped member in a form of a cone.

18. The method of claim 13, further comprising the step of:

metallizing said external surface of said cylinder-shaped member to form said external electrode.

19. The method of claim 13, further comprising the step of:

triggering the surface discharge on said internal surface of said cylinder-shaped member.

20. The method of claim 19, further comprising the step of:

controlling the energy of the surface discharge by varying an amplitude and duration of said triggering pulse.

21. The method of claim 19, further comprising the step of:

controlling the energy of the surface discharge by varying the capacitance of said capacitor.

22. A trigger in an electron generating device, the trigger comprising:

a cylinder-shaped member made of a dielectric material, said cylinder-shaped member having an external surface and a central opening formed in said cylinder-shaped member, said central opening extending longitudinally along the symmetry axis of said cylinder-shaped members and defining an internal surface thereof;

an internal electrode electrically coupled to said cylinder-shaped member at said internal surface thereof;

an external electrode electrically coupled to said cylinder-shaped member at said external surface thereof; and a source of a triggering pulse coupled between said internal and external electrodes, wherein, upon application of said triggering pulse between said internal and external electrodes, an electric field in vicinity of said internal electrode creates electrons emission from said internal surface of said cylinder-shaped member and formation of conducting plasma filling said central opening thereof, thus igniting the electron generating device to produce a beam of high-energy electrons, wherein said conducting plasma expands along said internal surface until a capacitor formed by said cylinder-shaped member and said external electrode is substantially fully charged.

23. The trigger of claim 22, wherein said external surface of said cylinder-shaped member is metallized, said metallization forming said external electrode.

24. The trigger of claim 22, wherein said central opening is a cylindrically shaped opening.

25. The trigger of claim 22, wherein said central opening is a conically shaped opening.

26. A method of triggering generation of electrons in an electrons generating device, comprising the steps of:

forming a central opening in a cylinder-shaped member made from a dielectric material having a dielectric constant $\epsilon>100$, said central opening extending longitudinally said cylinder-shaped member along the axis of symmetry thereof;

connecting an internal electrode to an internal surface of said cylinder-shaped member, said internal surface being defined by said central opening;

connecting an external electrode to an external surface of said cylinder-shaped member; and applying a triggering pulse between said internal and external electrodes to create emission of electrons from said internal surface of said cylinder-shaped member and to form conducting plasma in said central opening thereof, thus igniting the electrons generating device, wherein said emitted electrons are concentrated at said axis of symmetry of said cylinder-shaped member, and wherein an electrical field applied to said conducting plasma accelerates said concentrated electrons to a high energy, thus producing a high-energy electron beam.

27. The method of claim 26, further comprising the steps of:

metallizing said external surface of said cylinder-shaped member to form said external contact.

28. The method of claim 26, further comprising the step of:

controlling the formation of said conducting plasma by changing an amplitude and duration of the triggering pulse.

29. The method of claim 26, further comprising the step of controlling the formation of said conducting plasma by changing the capacitance of said capacitor.

* * * * *